US007207283B2

(12) United States Patent
Locke

(10) Patent No.: US 7,207,283 B2
(45) Date of Patent: Apr. 24, 2007

(54) MARINE CRAFT

(75) Inventor: Adrian John Locke, Waterlooville (GB)

(73) Assignee: Gibbs Technologies Limited (GB)

( * ) Notice: Subject to any disclaimer, the term of this patent is extended or adjusted under 35 U.S.C. 154(b) by 0 days.

(21) Appl. No.: 10/509,602

(22) PCT Filed: Mar. 21, 2003

(86) PCT No.: PCT/GB03/01192

§ 371 (c)(1),
(2), (4) Date: Sep. 24, 2004

(87) PCT Pub. No.: WO03/080428

PCT Pub. Date: Oct. 2, 2003

(65) Prior Publication Data

US 2005/0139137 A1 Jun. 30, 2005

(30) Foreign Application Priority Data

Mar. 26, 2002 (GB) ..... 0207056.3

(51) Int. Cl.
*B63B 59/02* (2006.01)

(52) U.S. Cl. ..... 114/219

(58) Field of Classification Search ..... 114/219
See application file for complete search history.

(56) References Cited

U.S. PATENT DOCUMENTS

| | | | | |
|---|---|---|---|---|
| 549,319 A | | 11/1895 | Katzin | |
| 991,224 A | | 5/1911 | Morauszky | |
| 1,130,809 A | | 3/1915 | Gerber | |
| 1,535,155 A | | 4/1925 | Hay | |
| 2,543,654 A | | 2/1951 | Baggerud | |
| 2,776,637 A | | 1/1957 | Chadwick | |
| 3,171,378 A | | 3/1965 | Lehmann | |
| 4,880,088 A | * | 11/1989 | De Oliveira | 188/377 |
| 5,353,727 A | * | 10/1994 | Goldman | 114/74 A |
| 5,542,365 A | | 8/1996 | Jurisich et al. | 114/65 |
| 5,803,004 A | * | 9/1998 | Swann et al. | 114/61.1 |
| 6,116,180 A | * | 9/2000 | Thompson | 114/271 |

FOREIGN PATENT DOCUMENTS

| | | |
|---|---|---|
| EP | 0799764 A1 | 10/1997 |
| WO | WO 00/35746 | 6/2000 |

OTHER PUBLICATIONS

International Search Report dated Sep. 7, 2003.

* cited by examiner

*Primary Examiner*—Stephen Avila
(74) *Attorney, Agent, or Firm*—Young Basile

(57) ABSTRACT

Marine craft has a crushable frontal impact protection structure, comprising transverse bulkhead protecting passenger area; longitudinal crushable tubes; and transverse member. Webs and strengthen tubes, which may be made of extruded, heat treated aluminum; stainless steel; or plastic. Tubes in FIGS. 5 to 7 are splayed, to improve protection against angled impacts C. The forward ends of tubes are tapered, (FIG. 3) to initiate deformation. Tubes may be hexagonal, round, or oval in cross-section. FIG. 8 shows longitudinal bulkheads, and transverse bulkhead in place of tubes. FIG. 9 shows longitudinal corrugated sheets; these may be mounted transversely. FIG. 10 shows how area filled with deformable cellular foam, to act as a buoyancy aid if hull is breached. Side and roar impact protection is also disclosed.

35 Claims, 3 Drawing Sheets

MARINE CRAFT

BACKGROUND OF THE INVENTION

The present invention relates to marine craft having an impact protection arrangement. In particular, the present invention relates to marine craft capable of planing and which have an impact protection system.

By the term "marine craft capable of planing", is meant marine craft which can obtain hydrodynamic lift by virtue of their speed across a body of water, rather than their lift being provided primarily by buoyancy.

Up to now, marine craft which are capable of planing have not been provided with any means of absorbing crash energy from high speed frontal impacts in a predictable and controlled manner. In order to plane, many marine leisure craft are capable of 30 knots (55 km/h) or more, hence impact closing speeds can be in excess of 60 knots (111 km/h). Such impacts may occur when the marine craft collides with another craft, with a jetty or with rocks, and can result in the sinking of the marine craft and serious injury to the helmsman and any passengers on board the craft. People on board marine craft often stand up, and those seated are generally not restrained with safety belts. Consequently, sudden deceleration of a marine craft due to a collision can cause people to be thrown over board.

Whilst frontal collisions are perhaps of most concern, collisions to the rear or a side of a marine craft may also result in injuries to occupants and severe damage to the craft, even though the impact speeds are generally lower. In respect of side impacts in particular, considerable deformation of the hull may be incurred through the intrusion of a bow of another craft. When hulls of small marine craft were made exclusively of wood, intrusion of the bow of another craft, even perpendicular to the gunwale, could result in considerable elastic deformation, but the wood would quickly spring back to its original shape without lasting damage. For all their maintenance advantages, more modern marine craft building materials, such as plastics or fibre reinforced plastics, are more liable to crack under impact. Thus even a relatively low speed impact to the side of a marine craft could result in the hull cracking and ultimately lead to the craft sinking.

It is known from U.S. Pat. No. 3,598,077, to provide a marine craft with an inflatable bow structure fitted externally of the main rigid bow and which is intended for cushioning the hull structure against wave impacts. An inflatable structure of this type would not be suitable for protecting the occupants of a marine craft from deceleration due to collisions; not least because of the strong likelihood of a sudden peak in deceleration as the inflatable structure burst on contact with another vessel or with a fixed obstruction. The structure requires large quantities of air to be supplied under pressure to maintain it in the inflated state. It is, therefore, principally intended for use in a craft having a hovercraft type inflatable outer skirt providing lift by virtue of air pressure supplied by fans, where the fans can also inflate the bow structure. Application of an inflatable bow structure to a conventional rigid hull craft capable of planing would require the use of fans specifically to inflate the bow. This would add significantly to the weight of the craft and would be a drain on the available power. Furthermore, the inflatable structure would increase the overall dimensions of the craft without improving its functionality in terms of additional storage space or vessel. components.

SUMMARY OF THE INVENTION

It is an object of the invention to provide a marine craft capable of planing in which the risk of sinking the craft as a result of a collision is reduced.

It is a further object of the invention to provide a marine craft capable of planing in which the deceleration forces on the craft and its occupants during a collision will be lessened, thus reducing the risk of an occupant being injured or thrown over board.

According to the broadest aspect of the invention, there is provided a marine craft capable of planing, the marine craft comprising a hull and a passenger area generally within the hull, characterised in that a means for absorbing impact energy is provided between the hull and the passenger area.

Preferably, the passenger area is spaced inwardly from at least a portion of the hull and the means for absorbing impact energy is located between the passenger area and the portion of the hull.

Preferably, the means for absorbing impact energy is a deformable structure. More preferably, the deformable structure is mounted between the hull and a structural component of the craft, which may be positioned adjacent a peripheral region of the passenger area. Advantageously, the structural component may be a bulkhead which separates the passenger area from at least a portion of the hull. In such an arrangement, it is particularly advantageous if the bulkhead is adapted to prevent, or at least to resist, movement of water into the passenger area from the hull portion.

In a preferred embodiment, the deformable structure comprises at least one deformable tube which extends between the hull and the structural component, a first end of the or each tube being associated with the hull, and a second end of the or each tube being associated with the structural component.

Preferably, the deformable structure comprises two or more deformable tubes extending between the hull and the structural component, the arrangement being such that at least two of the tubes extend at an angle relative to one another such that their first ends are further apart than their second ends. The at least two tubes may extend at an angle of up to and including 30 degrees to each other and in particular, the at least two tubes may extend at an angle of up to and including 20 degrees to each other.

Preferably, the first end of the or each tube is tapered, such that the cross sectional area of the tubes reduces towards the hull.

Where the deformable structure comprises two or more deformable tubes extending between the hull and the structural component, the structure may further comprise bracing means to resist lateral movement of the tubes towards one another during an impact.

The or each tube may be manufactured from a metal material such as steel, stainless steel, aluminium or aluminium alloy. The material may extruded and may be heat treated. Alternatively, the or each tube may be manufactured from a plastics, or a reinforced plastics, or a composite material.

Preferably, the or each tube has at least one internal web extending over at least part of its length.

In an alternative preferred embodiment, the deformable structure comprises at least one deformable plate which extends between the hull and the structural component. Preferably, the deformable structure comprises a plurality of spaced apart, deformable plates, each of which extend between the hull and the structural component. The or each plate may be aligned generally vertically of the craft or generally horizontally of the craft.

The or each plate may be substantially planar or corrugated. Where the deformable structure comprises two or more corrugated plates, the plates may be arranged such that the troughs and peaks of adjacent plates meet.

Where the deformable structure comprises two or more plates extending between the hull and the structural component, bracing means may be provided to resist movement of the plates towards each other during impact. Preferably, the bracing means comprises a further plate extending between adjacent plates.

The or each plate may be made of a metal, or a plastics, or a reinforced plastics, or a composite material.

In a further alternative embodiment, the deformable structure comprises a cellular material, such as expanded polystyrene or polyurethane foam. The cellular material is preferably bonded to the hull and the structural component.

Preferably, the hull defines a bow portion and the, or a, means for absorbing impact energy is located between the bow portion and the passenger area.

Preferably, the hull defines a stern portion and the, or a, means for absorbing impact energy is located between the stern portion and the passenger area.

Preferably, the hull defines a side portion, and the, or a, means for absorbing impact energy is located between the side portion and the passenger area.

Preferably, the hull defines a bow portion and a transverse bulkhead is provided which separates the passenger area from the bow portion, the, or a, deformable structure being mounted between the bow portion and the transverse bulkhead.

Preferably, the means for absorbing impact energy is adapted to absorb all or some of the impact energy in a predictable and controlled manner.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
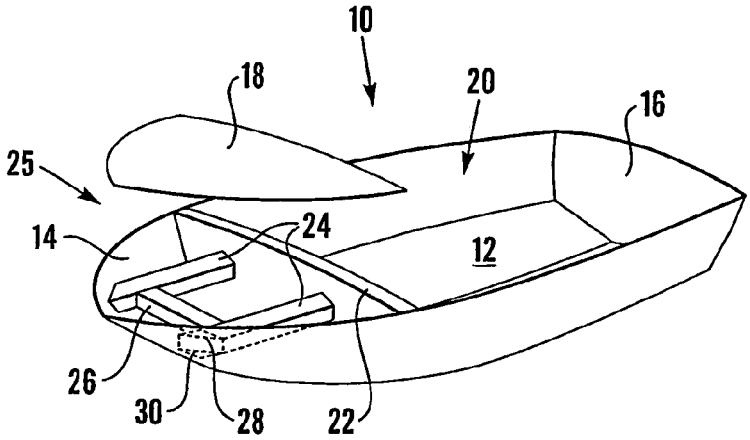
FIG. 1 is a diagrammatic, perspective view of a first embodiment of a marine craft in accordance with the invention, in which a deformable structure is mounted in the front of the craft, some hidden detail being omitted for clarity.
Figure 2:
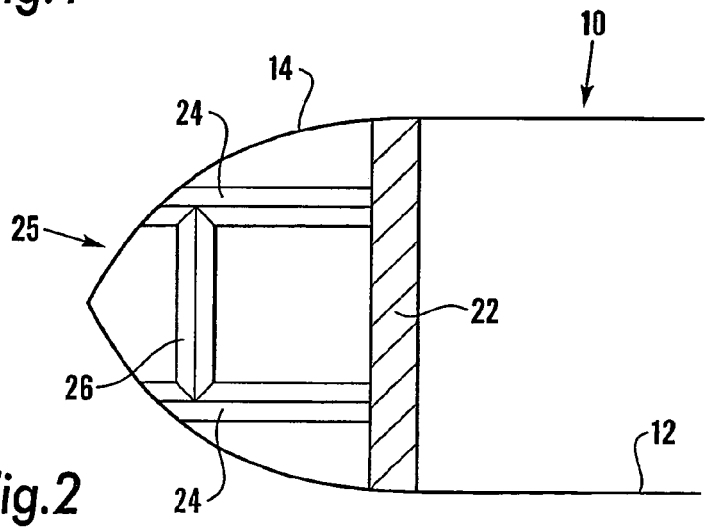
FIG. 2 is a diagrammatic, plan view of a front portion of the marine craft of FIG. 1.

Referring firstly to FIGS. 1 to 4, a first embodiment of a marine craft in accordance with the present invention is generally indicated at 10. The craft has a hull 12 which defines a bow portion 14 and a stern portion 16. The craft also has a bow top 18 (shown detached from the marine craft) for enclosing the bow portion. A passenger area of the craft 10 is indicated generally at 20. The passenger area 20 is located within the hull and is separated from the bows 14 by a structural bulkhead 22, which is positioned transversely in the craft 10 between the sides of the hull 12. Preferably, a water tight seal is formed between the edges of the bulkhead and the hull 12 and the bow top 18 (when fitted), to prevent, or at least to resist, water from entering the passenger area 20 from the bows should the bows become flooded, for example, in the event of the bows rupturing during a collision of the craft.

A deformable or crushable structure, indicated at 25, for absorbing impact energy is located between the bow portion 14 of the hull and the passenger area 20. The deformable structure 25 comprises a pair of collapsible tubes 24, a first end of the tubes being connected to the bows 14, and a second end of the tubes being connected to the transverse bulkhead 22. A structural cross member or brace 26 is connected transversely between the tubes 24. The brace 26 provides stability to the structure 25 and prevents the tubes 24 from simply being bent or deflected towards each other in the case of a frontal impact which is offset from the centre line of the craft.

The tubes 24 are manufactured from extruded aluminium and are designed to progressively deform, whilst absorbing energy, in a predictable and controlled manner during a frontal impact of the craft. The extruded aluminium tubes may be heat treated, for example by tempering, to improve their mechanical properties and to reduce the risk of the tubes tearing or splitting during an impact.

Extruded aluminium or aluminium alloy is the preferred material for the tubes because the high level of control which is possible in manufacture means that the tubes can have a very repeatable and predictable energy absorbtion performance. Also aluminium has good corrosion resistance in salt water environments. Nevertheless, the tubes 24 can be made from any suitable material such as steel, stainless steel, other metals, composite materials, or plastics, including fibre reinforced plastics.

Figure 4:
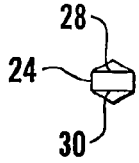
FIG. 4 is a sectional view through a tube forming part of the deformable structure of the marine craft of FIGS. 1 to 3.

As can be seen from FIG. 4, the tubes 24 have a hexagonal cross section, with two webs 28, 30 respectively joining the first and third, and fourth and sixth internal vertices of the hexagon. The webs 28, 30 extend along the length of the tubes and increase the amount of energy which can be absorbed for a given length of tube. The webs also act to stabilize the section against bending.

Although the tubes 24 have been described as being hexagonal in cross section, tubes of any suitable cross section can be used. For example the tubes 24 may be circular or oval in cross section. Furthermore, the structural cross member or brace 26 may have the same cross section as the tubes 24 or it may have a different cross section.

Figure 3:
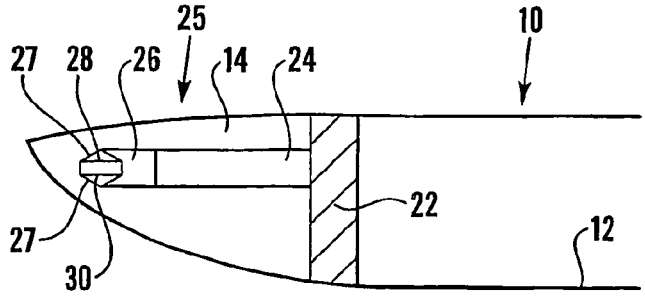
FIG. 3 is a diagrammatic, side view of a front portion of the marine craft of FIGS. 1 and 2.

As indicated at 27 in FIG. 3, the top and bottom of each of the tubes 24 are tapered inwardly towards the hull from close to the point at which the tubes are connected to the cross member 26. The ends of the tubes closest to the hull thus have a reduced cross sectional area, which means that deformation of these ends can be initiated at a reduced load compared with the rest of the tubes. This helps to ensure that the tubes start collapsing from the outer ends, thus absorbing impact energy in a controlled manner over the maximum length of the tubes 24.

During an impact, the tubes 24 will progressively buckle and deform along their length absorbing some or all of the impact energy in a predictable and controlled manner. This reduces the deceleration levels experienced by the occupants 0and minimises deformation in the passenger area. It will be apparent that the structural bulkhead 22 must be designed with sufficient strength to resist the axial loading required to initiate buckling of the tubes 24.

Figure 5:
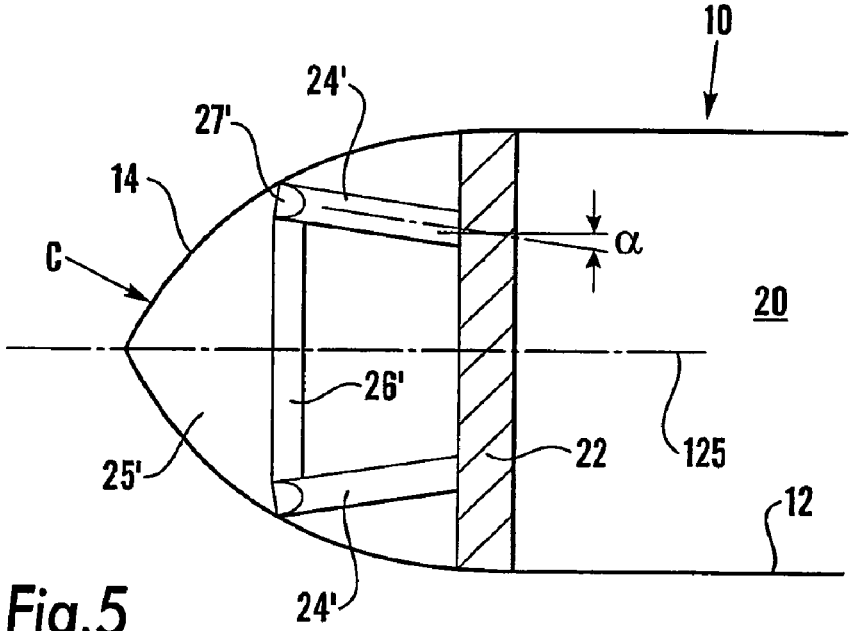
FIG. 5 is a view similar to that of FIG. 2, showing a modification to the deformable structure of the first embodiment.
Figure 6:
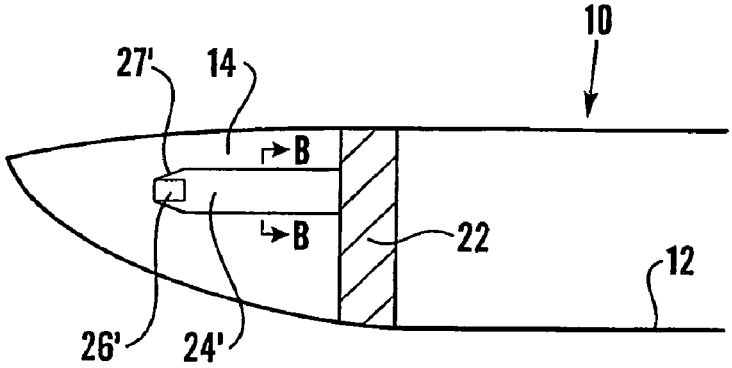
FIG. 6 is a diagrammatic a side view of the modified deformable structure of FIG. 5.
Figure 7:
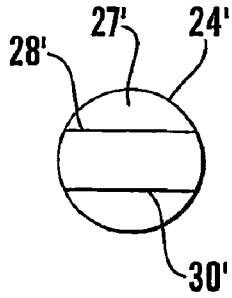
FIG. 7 is an enlarged cross sectional view of a tube forming part of the modified deformable structure, taken on line B—B of FIG. 6.

FIGS. 5 to 7, show a modified deformable structure 25' in which the tubes 24' connected between the transverse bulkhead 22 and the bows 14 are splayed outwardly from the longitudinal centre line 125 of the craft by an angle $\alpha$ and the structural member 26' connects the forward end of each tube 24'.

By angling the tubes 24' outwardly as shown, the deformable structure is better able to cope with impacts which occur at an angle to the bows such as that indicated by the arrow C. In the arrangement shown in FIGS. 1 to 4, where the tubes 24 extend parallel to the longitudinal centre line of the craft and to each other, there is a risk that an angled impact may cause the whole structure 25 to be deflected sideways rather than to crumple. This risk is reduced or eliminated by angling the tubes 24' outwardly.

It has been found that an angle $\alpha$ of up to fifteen degrees, and in particular an angle $\alpha$ of up to ten degrees, is effective in causing the tubes 24' to crush longitudinally where a collision C occurs at an angle of up to thirty degrees from the centre line 125, whilst still being effective in a head-on collision. Considered another way, the tubes 24' are arranged such that they are angled outwardly relative to one another by an angle of up to thirty degrees, and in particular by an angle of twenty degrees.

In the modified structure 25', the tubes 24' have a circular cross section, as is shown in FIG. 7, with parallel spaced webs 28', 30' extending along the length of the tubes, again to increase the amount of energy which can be absorbed for a given length of tube. As is indicated at 27', the outer ends of the tubes are tapered inwardly towards the hull.

Although the tubes 24' have been described as being circular in cross section, this is not essential and the tubes 24' can be of any suitable cross section. For example the tubes 24' could be oval in cross section with curved or flat sides or the tubes could be polygonal in cross section as with the tubes 24 in FIGS. 1 to 4. In the modified structure 25', the structural cross member or brace 26' is of rectangular cross section as can be seen from FIG. 6.

Whereas in the embodiments described above, the deformable structures 25, 25' comprises two tubes extending between the hull and the bulkhead, this is not essential and more or less than two tubes can be used as required.

Further embodiments of the invention will now be described with reference to FIGS. 8 to 10. The same reference numerals have been used to designate parts of the marine craft which are common to all of the embodiments, including the hull 12, the bows 14, the stern 16, the structural transverse bulkhead 22 and the passenger area 20.

Figure 8:
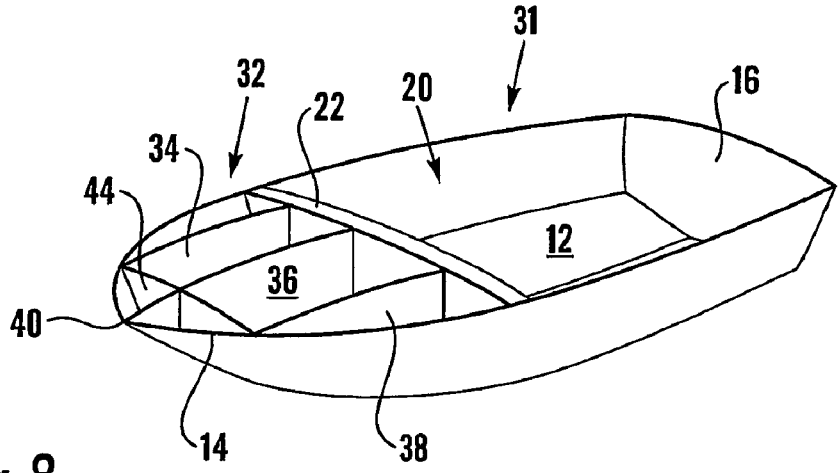
FIG. 8 is a view similar to that of FIG. 1, showing a second embodiment of a marine craft in accordance with the invention, having an alternative form of deformable structure.

A further embodiment of a marine craft in accordance with the invention is indicated at 31 in FIG. 8, and comprises a deformable structure 32, mounted between the transverse bulkhead 22 and the bows 14. The deformable structure 32 includes three generally vertically aligned, deformable plates 34, 36, 38 which are spaced apart and extend between the hull and the transverse bulkhead. The plates 34, 36, 38 are aligned generally parallel to each other and to the longitudinal axis of the craft. The central plate 36 is in alignment with the central axis of the craft 31 and extends from the transverse bulkhead 22 to the tip of the bows 40. The other plates 34, 38 are positioned on either side of the central plate 36. A brace 44, in the form of a transverse plate, connects the ends of the outer deformable plates 34, 38 to the central deformable plate 36 and resists movement of the deformable plates towards each other during an impact which is offset from the centre line of the craft. The deformable plates 34, 36, 38 are designed to crumple or buckle in the event of a frontal impact, so as to absorb some or all of the impact energy in a controlled and predictable manner. Although the deformable structure 32 is shown as having three deformable plates, this is not essential and more or less than three plates can be used as required.

Figure 9:
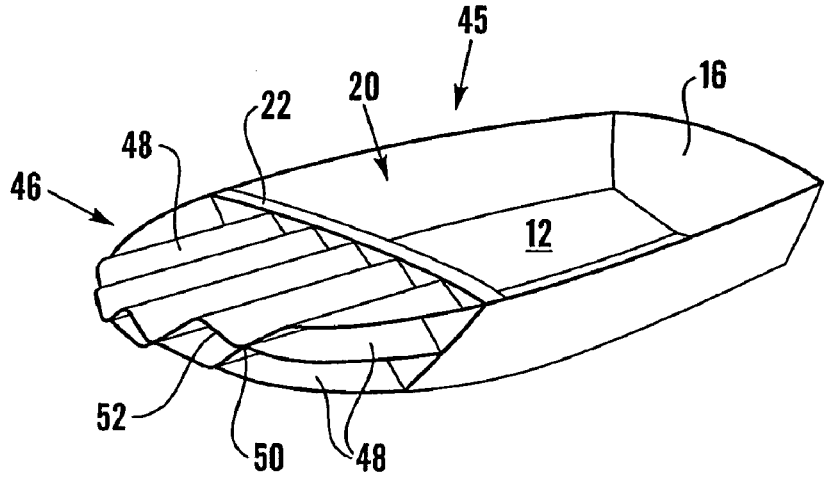
FIG. 9 is a view similar to that of FIG. 1, showing a third embodiment of a marine craft in accordance with the invention having a yet further alternative form of deformable structure.

Indicated at 45 in FIG. 9, is a yet further embodiment of a marine craft in accordance with the invention which includes a deformable structure 46. In this figure the bows 14 of the craft 45 have been omitted, in order to show the deformable structure 46 more clearly.

The deformable structure 46 comprises three deformable, corrugated plates 48 which are arranged generally horizontally of the craft and which extend between the transverse bulkhead 22 and the bow portion 14 of the hull 12. In the embodiment as shown, the corrugations are aligned parallel with the longitudinal axis of the craft 45. In an alternative arrangement (not shown), the corrugations are aligned perpendicular to the longitudinal axis of the craft 45.

In the present embodiment, three corrugated plates 48 are positioned one above the other, and adjacent plates 48 are connected together where peaks 50 and troughs 52 in the corrugations of the respective plates 48 meet. The plates 48 can be made of any suitable material such as metal, plastics, reinforced plastics or composite materials and are designed to crumble or buckle in the event of a frontal impact, so as to absorb the impact energy in a controlled and predicable manner. Although the present embodiment uses three corrugated plates, this is not essential and more or less than three plates can be used as required.

Figure 10:
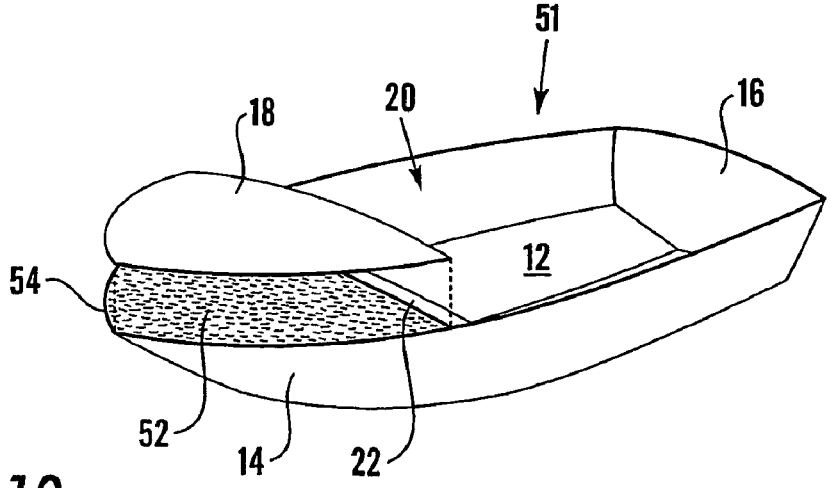
FIG. 10 is a view similar to that of FIG. 1, showing a fourth embodiment of a marine craft in accordance with the invention having a still further alternative form of deformable structure.

In a final embodiment, shown in FIG. 10, a deformable structure 54 is provided by filling the area between the transverse bulkhead 22 and the bows portion 14 of the hull 12 with a deformable cellular material 52, for example expanded polystyrene or polyurethane foam. The cellular material 52 is bonded to the bulkhead 22 and the inside of the bows 14 and acts as a buoyancy aid, as well as a deformable structure 54 for absorbing impact energy in a collision. A bow top 18 is also shown detached from the marine craft 51 as in FIG. 1.

In all of the embodiments shown, the deformable structures 25, 25', 32, 46 or 54 are designed to buckle or deform in a typical head-on or near head-on impact collision. In buckling or deforming, the deformable structures 25, 25', 32, 46 or 54 absorb impact energy in a controlled and predictable manner, so as to reduce to some extent the rate of deceleration of the craft. In the event of a collision, the structural transverse bulkhead 22, which extends between the sides of the water craft hull 12, transmits deceleration forces to the craft, and maintains the integrity of the passenger area 20, thus reducing the risk of the craft sinking. Whilst the deformable structures have been shown as being mounted between the hull and a structural bulkhead, this arrangement is not essential to the invention. For example, the deformable structures could be mounted between the hull and any suitable structural component of the craft which is capable of resisting the load required to initiate deformation of the deformable structure and of transmitting the deceleration forces to the craft. The structural component could, for example, be a frame member of the craft positioned adjacent a peripheral region of the passenger area. In such an arrangement, a watertight bulkhead may also be provided to seal the passenger area from the hull in the region of the deformable structure. Furthermore, the structural component need not be a single integral component but could comprise of a number of discrete structural elements. For example, in the deformable structures 25, 25', each of the tubes could be mounted to a separate frame member.

Although the embodiments described above are shown in the front of the craft and are arranged to reduce the effects of frontal collisions, any of those embodiments may be readily adapted to be built into the stern of the craft.

In addition, deformable structures similar to those described above can be provided between the passenger area and a side portion of the hull. For example, deformable tubes 24 or 24', deformable plates 34, 36, 38, or 48, or deformable cellular material 52 could be positioned between a side region of the hull 12 and the passenger area to reinforce the sides of the hull. As discussed above, modern marine craft building materials are more prone to cracking under impact than traditional wood materials. It is therefore desirable to limit hull deformation, not only to limit deceleration forces on passengers, but also to maintain the buoyancy of the vessel. Plastic reinforcing tubes, corrugated plates or foam all offer good deformation characteristics and are particularly suited for use in this area.

It should be noted that the term "marine craft" is intended to include amphibious craft within its scope, even though the marine craft shown in the Figures are all depicted as small boats of conventional shape.

The invention claimed is:

1. A marine craft capable of planing, the marine craft comprising a planing hull and a passenger area generally within the hull and means between the hull and the passenger area for absorbing impact energy, characterised in that the means for absorbing impact energy includes a structure arranged to absorb inpact energy by permanently deforming in the event of the craft suffering an impact in the region of the structure.

2. A marine craft as claimed in claim 1, in which the passenger area is spaced inwardly from at least a portion of the hull and the means for absorbing impact energy is located between the passenger area and the portion of the hull.

3. A marine craft as claimed in claim 1, in which the means for absorbing impact energy is a deformable structure.

4. A marine craft as claimed in claim 3, in which the deformable structure is mounted between the hull and a structural component of the craft.

5. A marine craft as claimed in claim 4, in which the structural component is positioned adjacent a peripheral region of the passenger area.

6. A marine craft as claimed in claim 4, in which the structural component is a bulkhead which separates the passenger area from at least a portion of the hull.

7. A marine craft as claimed in claim 6, in which the bulkhead is adapted to prevent, or at least to resist, movement of water into the passenger area from the hull portion.

8. A marine craft as claimed in claim 4, in which the deformable structure comprises at least one deformable tube which extends between the hull and the structural component, a first end of the or each tube being associated with the hull, and a second end of the or each tube being associated with the structural component.

9. A marine craft capable of planning, the marine craft comprising a hull and a passenger area generally within the hull and means between the hull and a passenger area for absorbing impact energy, characterized in that the means for absorbing impact energy includes a structure arranged to absorb impact energy by permanently deforming in the event of the craft suffering an impact in the region of the structure wherein the means for absorbing impact energy is a deformable structure mounted between the hull and a structural component of the craft and the deformable structure comprises:

at least one deformable tube which extends between the hull and the structural component, a first end of the or each tube being associated with the hull,and a second end of the or each tube associated with the structural component and two or more deformable tube extending between the hull and the structural component, the arrangement being such that at lease two of the tubes extend at an angle relative to one another such that their first ends are further apart the their second ends.

10. A marine craft as claimed in claim 9, in which the at least two tubes extend at an angle of up to and including 30 degrees to each other.

11. A marine craft as claimed in claim 9, in which the at least two tubes extend at an angle of up to and including 20 degrees to each other.

12. A marine craft capable of planing, the marine craft comprising a hull and a passenger area generally within the hull and means between the hull and the passenger area for absorbing impact energy, characterized in that the means for absorbing impact energy includes a structure arranged to absorb impact energy by permanently deforming in the event of the craft suffering an impact in the region of the structure, in which the means for absorbing impact energy is a deformable structure and the deformable structure is mounted between the hull and a structural component of the craft in which the deformable structure comprises at least one deformable tube which extends between the hull and the structure component, a first end of at least one tube associated with the hull, and a second end of the at least one tube associated with the structural component, in which the first end of the at least one tube is tapered, such that the cross sectional area of the at least one tube reduces towards the hull.

13. A marine craft as claimed in claim 8, in which the deformable structure comprises two or more deformable tubes extending between the hull and the structural component, the structure further comprising bracing means to resist lateral movement of the tubes towards one another during an impact.

14. A marine craft as claimed in claim 12, in which the at least one tube is manufactured from a metal such as steel, stainless steel, aluminium, or aluminium alloy.

15. A marine craft as claimed in claim 14, in which the at least one tube is manufactured from a metal which is extruded.

16. A marine craft as claimed in claim 14, in which the at least one tube is heat treated.

17. A marine craft as claimed in claim 12 in which the at least one tube is manufactured from a plastics, or a reinforced plastics, or a composite material.

18. A marine craft as claimed in claim 12, in which the at least one tube has at least one internal web extending over at least part of its length.

19. A marine craft as claimed in claim 4, in which the deformable structure comprises at least one deformable plate which extends between the hull and the structural component.

20. A marine craft capable of planing, the marine craft comprising a hull and a passenger area generally within the hull and means between the hull and the passenger area for absorbing impact energy, characterized in that the means for absorbing impact energy include a structure arranged to absorb impact energy by permanently deforming in the event of the craft suffering an impact in the region of the structure, in which the means for absorbing impact energy is a deformable structure and the deformable structure is mounted between the hull and a structural component of the craft in which the deformable structure comprises at least one deformable plate which extends between the hull and the structure component and, in which the deformable structure comprises a plurality of spaced apart, deformable plates, each of which extend between the hull and the structural component.

21. A marine craft as claimed in claim 20, in which the or each plate is aligned generally vertically of the craft.

22. A marine craft as claimed in claim 20, in which the or each plate is aligned generally horizontally of the craft.

23. A marine craft as claimed in claim 20, in which the or each plate is substantially planar.

24. A marine craft as claimed in claim 20, in which the at least one plate is corrugated.

25. A marine craft as claimed in claim 24, in which the deformable structure comprises two or more corrugated plates arranged such that the troughs and peeks of adjacent plates meet.

26. A marine craft as claimed in claim 20, in which bracing means is provided to resist movement of the plates towards each other during impact.

27. A marine craft as claimed in claim 26, in which the bracing means comprises a further plate extending between adjacent plates.

28. A marine craft as claimed in claim 20, in which the at least one plate is made of a metal, or a plastics, or a reinforced plastics, or a composite material.

29. A marine craft as claimed in claim 4, in which the deformable structure comprises a cellular material, such as expanded polystyrene or polyurethane foam.

30. A marine craft as claimed in claim 29, in which the cellular material is bonded to the hull and to the structural component.

31. A marine craft as claimed in claim 1, in which the hull defines a bow portion and the means for absorbing impact energy is located between the bow portion and the passenger area.

32. A marine craft as claimed in claim 1, in which the hull defines a stern portion and the means for absorbing impact energy is located between the stern portion and the passenger area.

33. A marine craft as claimed in claim 1, in which the hull defines a side portion, and the means for absorbing impact energy is located between the side portion and the passenger area.

34. A marine craft as claimed in claim 1, in which the hull defines a bow portion and a transverse bulkhead is provided which separates the passenger area from the bow portion, a deformable structure being mounted between the bow portion and the transverse bulkhead.

35. A marine craft as claimed in claim 1, in which the means for absorbing impact energy is adapted to absorb all or some of the impact energy in a predictable and controlled manner.

* * * * *

UNITED STATES PATENT AND TRADEMARK OFFICE

CERTIFICATE OF CORRECTION

PATENT NO. : 7,207,283 B2
APPLICATION NO. : 10/509602
DATED : April 24, 2007
INVENTOR(S) : Adrian John Locke It is certified that error appears in the above-identified patent and that said Letters Patent is hereby corrected as shown below:

On the title page:

Column 2, ABSTRACT: Delete entire Abstract Paragraph and replace with

--Marine craft has a crushable frontal impact protection structure, comprising transverse bulkhead protecting passenger area; longitudinal crushable tubes; and transverse member. Webs strengthen tubes, which may be made of extruded, heat treated aluminum; stainless steel; or plastic. Tubes are splayed to improve protection against angled impacts. The forward ends of tubes are tapered to initiate deformation. Tubes may be hexagonal, round, or oval in cross-section. Longitudinal bulkheads and a transverse bulkhead may be used in place of tubes. Longitudinal corrugated sheets may be mounted transversely. The bow area may be filled with deformable cellular foam to act as a buoyancy aid. Side and rear impact protection is also provided.--

Column 1, Line 67: Delete the extra period after “vessel.”

Column 5, Line 13: Replace “0and” with --and--.

Column 7, Line 45: Replace “inpact” with --impact--.

Column 8, Line 7: Replace “planning” with --planing--.

UNITED STATES PATENT AND TRADEMARK OFFICE

CERTIFICATE OF CORRECTION

PATENT NO. : 7,207,283 B2
APPLICATION NO. : 10/509602
DATED : April 24, 2007
INVENTOR(S) : Adrian John Locke It is certified that error appears in the above-identified patent and that said Letters Patent is hereby corrected as shown below:

Column 8, Line 20: Replace “hull,and” with --hull, and--.

Column 8, Line 24: Replace “lease” with --least--.

Column 9, Line 34: Replace “peeks” with --peaks--.

Signed and Sealed this

Nineteenth Day of February, 2008

JON W. DUDAS
*Director of the United States Patent and Trademark Office*